US005271640A

United States Patent [19]

Potochick et al.

[11] Patent Number: 5,271,640

[45] Date of Patent: Dec. 21, 1993

[54] LIGHTED SKI POLE

[76] Inventors: Patrick Potochick, 32618 Bertram Dr., Westland, Mich. 48185; Timothy Potochick, 42164 Brentwood, Plymouth, Mich. 48170

[21] Appl. No.: 889,969

[22] Filed: May 29, 1992

[51] Int. Cl.[5] ..... A63C 11/22

[52] U.S. Cl. ..... 280/816; 280/819; 362/102

[58] Field of Search ..... 280/816, 819, 821, 809; 135/65, 66, 76, 910; 362/102

[56] References Cited

U.S. PATENT DOCUMENTS

| | | | |
|---|---|---|---|
| 2,173,624 | 9/1939 | Dger | 135/910 |
| 4,023,817 | 5/1977 | Lah et al. | 280/816 |
| 4,066,889 | 1/1978 | Hodgson | 280/816 |
| 4,562,850 | 1/1986 | Earley et al. | 135/910 |
| 4,625,742 | 12/1986 | Phillips | 135/910 |
| 5,056,821 | 10/1991 | Fierro | 280/816 |

*Primary Examiner*—Richard M. Camby

*Attorney, Agent, or Firm*—Weintraub, DuRoss & Brady

[57] ABSTRACT

A ski pole according to the present invention is provided with a translucent plastic tubular body portion which is easily and quickly interchangeable. The translucent body portion has an illuminating light source disposed therein which can be "on", "off" or intermittent flashing "on" and "off". The light source is connected to a power circuitry, power source and switch all of which are of solid state construction. A steady light emitting from the translucent body illuminates the skier's surrounding area. Alternatively, an intermittent light emitting from the translucent body provides a flashing signal.

7 Claims, 2 Drawing Sheets

LIGHTED SKI POLE

BACKGROUND OF THE INVENTION

1. Field of the Invention

This invention relates to ski poles. More particularly, this invention relates to ski poles which contain means for illumination.

2. Description of the Prior Art

The usefulness of providing some means for illumination within a support device used for night walking and skiing has long been known within the art. Such illuminating devices have commonly been used in walking canes or poles.

For example and as shown in U.S. Pat. Nos. 1,509,157; 4,062,371; 4,562,850; and 4,625,742, a cane or similar walking aid is fitted with an illuminating device which provides the user with means of lighting the walkway.

Other illuminating devices have been installed in walking canes to provide notice to others during times of difficult visibility that the user is present. Typical of such devices is found in U.S. Pat. Nos. 2,245,349 and 4,099,535 which disclose a cane or a portion of the cane having a red light emitting source or other lighted surface.

Walking canes, however, are not useful for skiing and are not designed to accommodate the rugged use ski poles experience on a day to day basis. Ski poles are typically used in a hostile environment, are placed under great stress, and are subject to a great deal of abuse. This is especially true when used by the more experienced skier who would be more likely to ski at night.

Night skiing presents unique problems not present during daylight skiing. The most obvious problems are related to visibility. Most ski areas, lighted for night skiing, do not use high intensity lighting because the glare reflecting from the snow would severely handicap the skier. Therefore, the low intensity lighting that is used creates shadows and unilluminated areas upon the ski slope. On some ski slopes, these unlighted areas may be very large. When a skier ventures into these areas, he or she may be difficult to see by others as well as having difficulty seeing. Yet, many experienced skiers choose to ski on unlighted slopes using only the natural light, for example, light provided by the moon. However, skiing is a solitary sport and frequently a skier will become separated from a group or will be skiing along by choice. Locating such skiers should they become lost or injured at night is extremely difficult without the use of something to aid the searchers.

Illuminating the ski pole used by a skier is a method of providing the skier with a light source. The light source can be used for locating the skier as well as be used by the skier to see his or her way. The art, heretofore, has disclosed ski poles having an illumination source associated therewith. For example, in U.S. Pat. No. 4,066,899, an illumination device is disclosed as being disposed within a ski pole. The illumination device is a standard lamp, powered by dry cell batteries, and operated by an off-on switch. When the switch is set to "on", the batteries are urged against a contact which is wired to a lamp socket. The lamp lights a translucent strip in the wall of the ski pole. Also, the light is reflected from a mirror located near the tip of the ski pole and exits through a lens in the wall of the ski pole. This illuminating device has several disadvantages considering the demands made upon the ski pole during its use. The notches created in the wall of the pole for the translucent strip and the lens substantially weakens the pole. Also, the wires, mirror and lamp can become loose or disconnected during normal use of the pole, thereby rendering the pole useless for night skiing.

In U.S. Pat. No. 4,129,311, an illuminating device using a "Cyalume" light stick is disclosed. the "Cyalume" light stick, which is commercially available, is capable of providing light via a chemical charge without an outside source of power. However, a dry cell battery power source is used to provide continued charge to the "Cyalume" light stick after the chemical charge of the light stick dissipates. This method of illumination eliminates lamps, wires and mirrors, but, it presents its own disadvantages. The light is emitted to the outside through a translucent strip in the wall of the ski pole which weakens the pole. Also, even with the extra battery power source, the "Cyalume" light stick loses its ability to transmit light and must be replaced. Further, there is no way to switch "off" the light stick once it is charged. Additionally, the light stick is not a strong light emitter and is difficult to use as a light source to see by.

An illuminating device installed within the handle of a ski pole is disclosed in U.S. Pat. No. 4,206,445. The lamp, switch and circuitry are disposed within the ski pole grip or handle. The lamp is powered by dry cell batteries which are housed in the top of the ski pole beneath the grip. The switch is a three-way switch, "off", "on" and "intermittent flashing". The illumination from the light is emitted through a translucent plastic cover positioned over the lamp at the top of the handle. This device addresses the problem of weakening the ski pole by placing the translucent plastic in the wall of the pole. However, the location of the lamp and translucent cap limit the use of the pole to light the skier's way. The skier must stop and lower the handle to direct the light to the surface of the slope. It is difficult to alternately ski and stop every time the skier needs to see the slope. Also, with large, bulky ski gloves, the lens could be covered, blocking any light emitting from the handle. Further, the gloves may interfere with using the switch installed in the handle.

There is a need for a lighted ski pole which is able to withstand the stresses of skiing, provide lighting for signalling and for lighting the skier's way, and which permits the illuminating device to be easily interchanged or replaced.

SUMMARY OF THE INVENTION

The lighted ski pole of the instant invention is designed to overcome all of the problems encountered with prior art devices of the type. In accordance with the present invention, there is provided a lighted ski pole for use as a signal and to light the skier's way. The lighted ski pole hereof, generally, comprises:

(a) a lower member, the lower member having a connecting end and a tip end;

(b) an interchangeable translucent medial portion, the translucent portion having a first engaging end and a second engaging end, the second engaging end being removably connected to the connecting end of the lower member;

(c) a tubular upper member, the upper member having a top end and a bottom end, the bottom end being removably connected with the first engaging end of the medial portion;

(d) a handle member, the handle member having an inserting end and a cap end, the inserting end being removably connected to the upper member proximate to the top end of the tubular upper member; and (e) means for illuminating the translucent medial portion, the means for illuminating being disposed within the medial portion and the tubular upper member.

The ski pole is made in sections and each section is designed to withstand the great stresses placed upon the pole by the skier during skiing. The lower member and the upper tubular member are, generally, made from a suitable metal, such as aluminum or the like. The translucent medial portion is made from a high strength plastic, such as clear polycarbonate, commercially available as "Lexan" or the like. The handle member or grip is made of molded rubber, but may be made of other rubber type materials. The integrated sections define a single ski pole capable of withstanding stresses equal to or greater than the individual sections.

Disposed within the ski pole is the means for illuminating the translucent portion of the pole. The means for illuminating is comprised of a light source preferably disposed within the medial translucent portion, a power source preferably disposed within the upper tubular member, a power circuit for engaging the power source and light source preferably disposed within the upper tubular member, and a two-way or three-way switch, preferably a three-way switch, disposed within the handle member. The switch has three states, "off", with no light; "on", with the light source continually emitting light; and "intermittent" with the light source flashing "on" and "off". The continuous light is used for lighting the skier's way and for providing a continuous signal of the skier's presence. The "intermittent" or flashing light is traditionally used for a signal.

The light source is integrated with the translucent portion. When the light source needs to be replaced, the translucent portion is replaced with another translucent portion. Interchanging of translucent portions may be made any time the skier desires instead of waiting until the portion requires replacement. Interchangeability permits the translucent portion to be various colors and/or have an unlimited number of unique designs thereon.

The power source for the light source is, generally, at least one dry cell battery. The light source is, generally, a LP MODE fiber optic lamp, commercially available. The circuitry that connects the power source and the light source at the switching is, generally, of solid state construction. This eliminates wires and other elements which may come loose during use.

Other attendant advantages will be more readily appreciated as the same become better understood by reference to the following detailed description and considered in connection with the accompanying drawings, in which like reference numerals designate like parts throughout the figures.

DESCRIPTION OF THE PREFERRED EMBODIMENT

Figure 1:
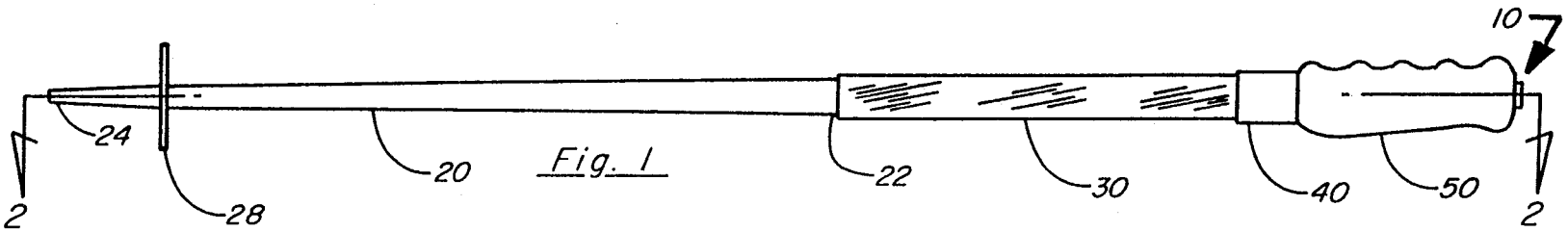
FIG. 1 is a side elevational view of the ski pole hereof with the sections assembled.

The instant invention, as depicted in FIGS. 1 through 4 is a lighted ski pole 10. The ski pole 10, generally, comprises:

(a) a lower member 20, the lower member 20 having a connecting end 22 and a tip end 24;

(b) an interchangeable translucent medial portion 30, the translucent portion having a first engaging end 32 and a second engaging end 34, the second engaging end 34 being removably connected to the connecting end 22 of the lower member 20;

(c) a tubular upper member 40, the upper member 40 having a top end 42 and a bottom end 44, the bottom end 44 being removably connected to the first engaging end 32 of the translucent medial portion 30;

(d) a handle member 50, the handle member being molded over and around the upper member proximate the top end, the handle member 50 having an inserting end 54 and a cap end 52; and (e) means for illuminating 60 the translucent medial portion 30, the means for illuminating 60 being disposed within the medial portion 30, upper member 40, and handle member 50.

The lower member 20 is preferably a hollow tube which is tapered from the connecting end 22 to the tip end 24. The tubular member 20 is usually made from a light strong metal, such as aluminum or the like, or an extra strong plastic, such as Lexan or the like. The tubular member 20 is that portion of the ski pole 10 which comes in contact with the skiing surface. A disk 28, commonly called a "ski pole basket" is disposed on the lower member 20 proximate to the tip end 24. The disk 28 prevents the ski pole from sinking into the snow surface beyond the disk 28. Although the lower member is preferably a tube, a solid cylinder may be used.

Means for threadably engaging 26 are formed on the tubular member 20 proximate the connecting end 22. The means for threadably engaging 26 provides a method of being removably connected to the translucent screw medial portion 30.

The translucent medial portion 30 is a hollow tube 36 tapered from the first engaging end 32 to the second engaging end 34. The tube 36 has an internal wall 36*a* and an external wall 36*b*. The tube 36 is preferably made from a translucent polycarbonate plastic, such as "Lexan" or the like. "Lexan" is generally available from the manufacturer thereof.

Figure 2:
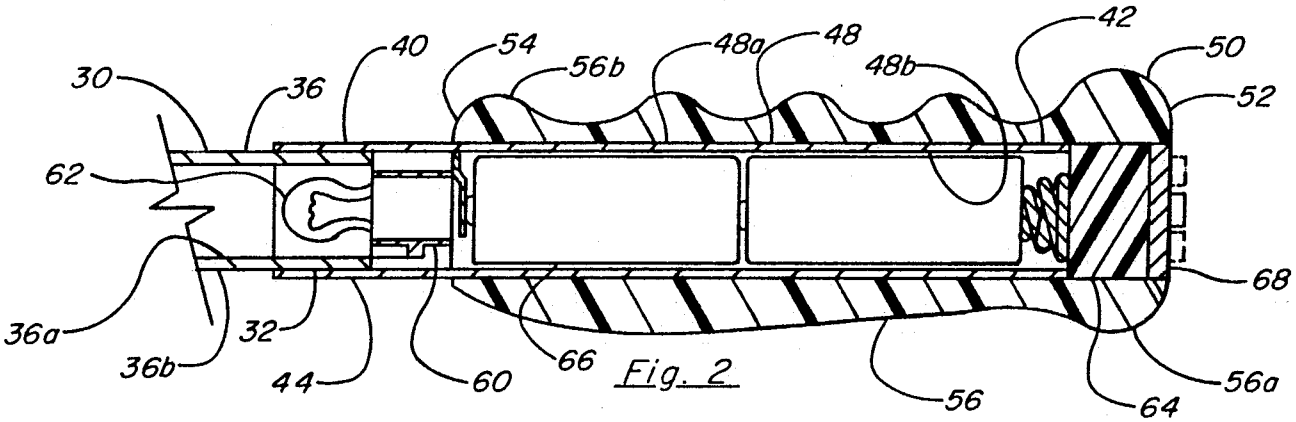
FIG. 2 is a cross-sectional view of a portion of the assembled ski pole.

The tube 36 has first means for threadingly engaging 38*a* formed on the internal wall 36*a* proximate the second engaging end 34. Second means for threadingly engaging 38*b* are formed on the external wall 36*b* of the tube proximate the first engaging end 32. The second means for threadingly engaging 38*b* of the median portion 30 are rotatably engaged with the means for threadingly engaging 26 on the connecting end 22 of the lower member 20. The first means for threadingly engaging 38*a* are rotatably engaged with the means for threadingly engaging 46 proximate the bottom end 44 of the upper member 40, as depicted in FIG. 2.

The upper tubular member 40 is a hollow tube 48 which is tapered from the top end 42 to the bottom end 44. The tube 48 has an outside wall 48*a* and an inside wall 48*b*. The means for threadingly engaging 46 are formed proximate the bottom end 44, on the inside wall 48*b* of the tube.

The upper member 40 is preferably made from a strong light metal such as aluminum or the like.

The handle member 50 is preferably molded onto the upper member 40 surrounding that portion of the upper member 40 proximate the top end 42. Alternatively, the handle member 50 may be removably attached to the upper member 40 by using screws or the like or it may be adhesively attached to the upper member 40.

The handle member 50 is made from a grippable material such as rubber or the like. The handle member 50 has a cap end 52 and an inserting end 54. A first collar 56*a* is formed proximate the cap end 52 of the handle member 50 and a second collar 56*b* is formed proximate the inserting end 54 of the handle member 50. The collars 56*a* and 56*b* are integrated with a handle member body 5 to define the gripping portion of the handle member.

The angle of the taper for each of the separate tapered sections 20, 30, and 40 of the ski pole 10 shall be identical defining an overall uniform taper for the ski pole 10 although being off-set at the intersections of the sections.

The means for illuminating 60 is disposed within the translucent medial portion 30, upper tubular member 40 and handle member.

Figure 3:
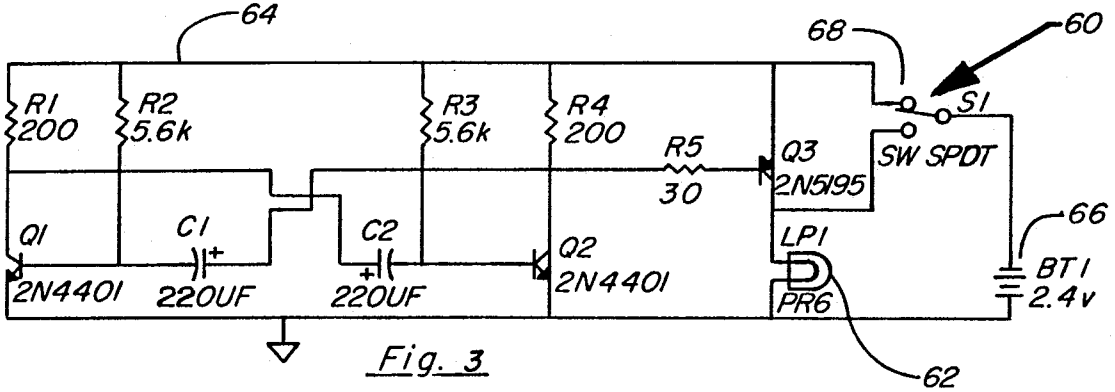
FIG. 3 is a schematic of the circuitry of the illuminating means.
Figure 5:
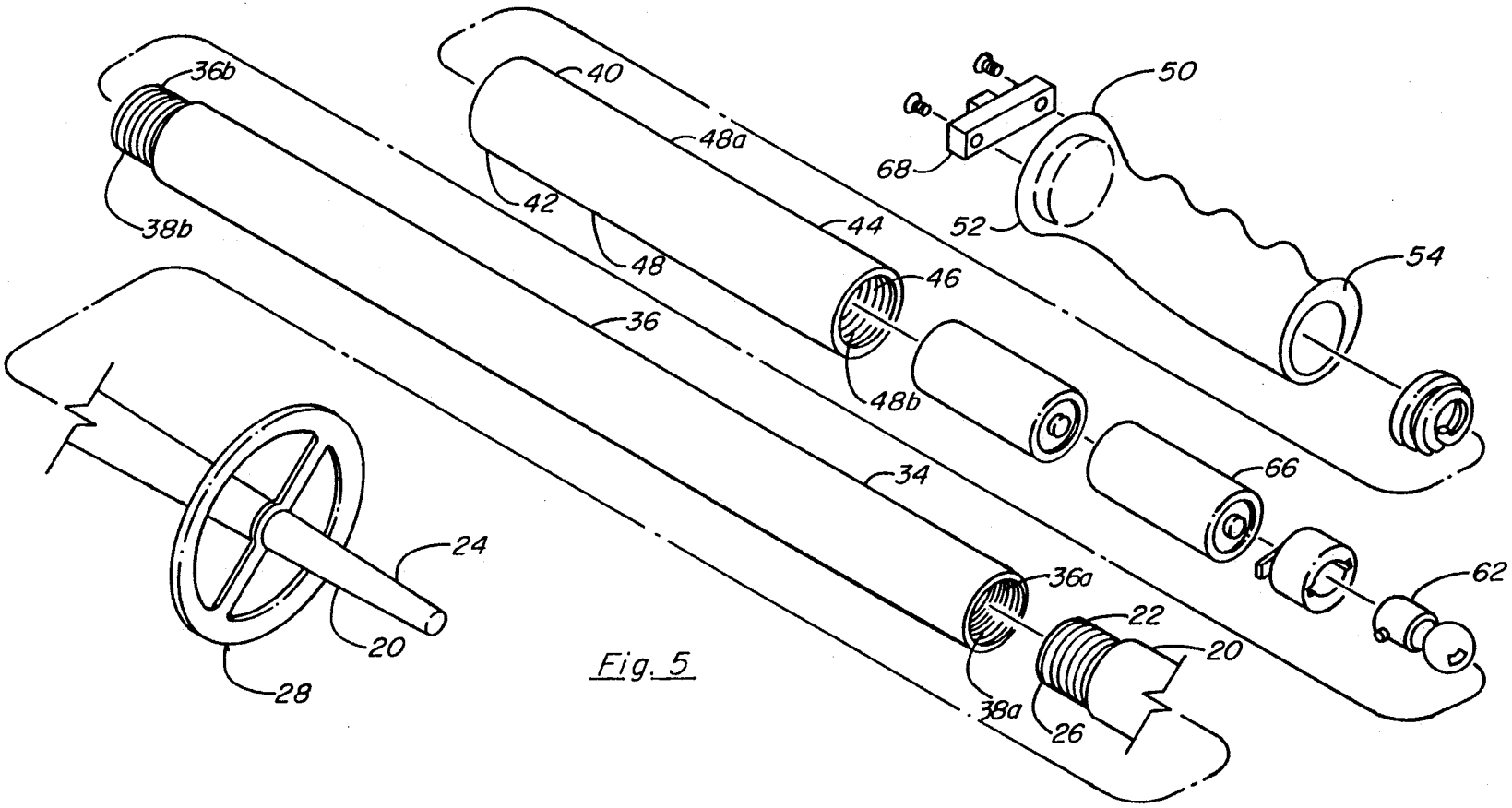
FIG. 5 is a side view of the ski pole hereof with the sections not assembled.
Figure 4:
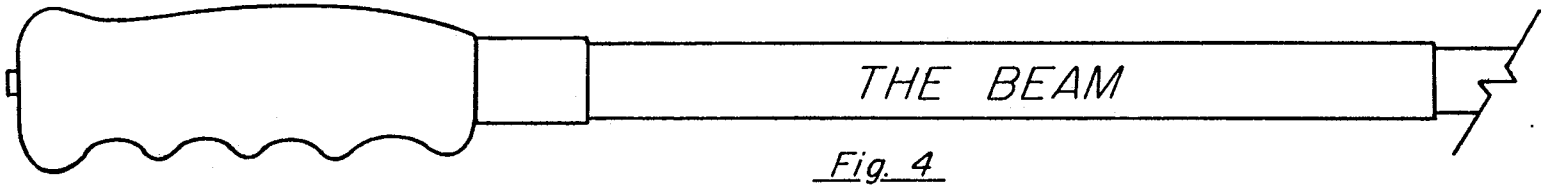
FIG. 4 is an exploded perspective view of the ski pole hereof.

Means for illuminating 60, as shown in FIGS. 2 and 3, generally, comprises:

(a) a light source 62;

(b) a power source 66;

(c) a power circuit 64, the power circuit 64 being cooperatively connected to the light source 62 and the power source 66; and (d) a switch 68, the switch 68 preferably having three conditions or stages of: "on"; a condition of "off"; and a condition of "intermittent flashing off and on"; the switch 68 further being cooperatively connected in the power circuit 64 intermediate the light source 62 and the power source 66.

The light source 62 is preferably an incandescent light commercially available from any one of several manufacturing sources.

Alternatively, the light source 62 may be a solid state emitting diode (LED) also commercially available from any one of several manufacturing sources.

As another alternative, the translucent medial portion 30 may contain the light source 62 with the elements that comprise the light source 62 embedded between the walls 36*a* and 36*b* of the translucent medial portion 30.

Alternatively, the translucent medial portion 30 may contain the light source 62 with the elements that comprise the light source 62 imbedded between the walls 36*a* and 36*b* of the translucent medial portion 30.

The power circuit 64 is preferably comprised of solid state circuitry, as depicted in FIG. 3, and is disposed within the upper tubular member 40 proximate the bottom end 44. The power circuit 64 is cooperatively connected to the light source 62, the power source 66 and the switch 68. The elements of the power circuit 64 are commercially available from several manufacturing sources.

The power source 66 is preferably a dry cell battery of at least 2.4 volts which is commercially available from several manufacturing sources. The power source 66 is disposed within the upper tubular member 40 and is cooperatively connected to the power circuit 64 and the switch 68.

The switch 68, a solid state "three-way" or "three position" switch, is disposed within the handle member 50 proximate the cap end 52. When the switch 68 is set on "off", the current flow is broken; when the switch 68 is set to "on", there is a continuous current flow to the power circuit 64; and when the switch 68 is set to "intermittent flash", the current flow to the power circuit 64 is alternating between "on" and "off". Alternatively, the switch 28 may be a two-way switch.

It is appreciated that there has been described herein a ski pole 10 which not only provides the ability for the skier to light his way or signal at night, but which is capable of withstanding the high stress environment of being used in cold temperatures. Additionally, and of great value, the ski pole 10 provides an ability to quickly and easily change the translucent medial member when desired.

Having, thus, described the invention, what is claimed is:

1. An illuminatable ski pole comprising:

(a) a lower member, the lower member having a connecting end and a tip end, the lower member being tapered from the connecting end to the tip end;

(b) an interchangeable translucent medial portion, the translucent medial portion having a first engaging end and a second engaging end, the translucent medial portion being tapered from the first engaging end to the second engaging end, the translucent medial portion being a polycarbonate hollow tube, the tube having an internal wall and an external wall, the internal wall having a first means for threadably engaging formed thereon proximate the second engaging end, the external wall having a second means for threadably engaging formed thereon proximate the first engaging end, the second engaging end being removably connected to the connecting end of the lower member;

(c) a tubular upper member, the upper member having a top and bottom end, the bottom end being removably connected to the first engaging end of the translucent medial portion, the upper member being a hollow tube tapered from the top end to the bottom end;

(d) a handle member, the handle member disposed over and around the upper member proximate the top end, the handle member having an intersecting end and a cap end;

(e) means for illuminating the translucent medial portion, the means for illuminating being disposed within the ski pole; and wherein the means for threadably engaging define the interchangeability of the translucent medial portion.

2. The ski pole of claim 1 wherein the lower tubular member comprises:

a hollow metal tube, and means for threadably engaging the translucent medial portion formed thereon proximate the connecting end.

3. The ski pole of claim 1 wherein the lower member comprises:

a solid cylinder, and means for threadably engaging the translucent medial portion formed thereon proximate the connecting end.

4. The ski pole of claim 1 wherein the tubular upper member comprises:

a hollow metal tube having an outside wall and an inside wall, and means for threadably engaging the translucent medial portion formed thereon.

5. The ski pole of claim 1 wherein the handle member comprises:

a hollow body, the body being molded over and around the outside wall of the tubular upper member proximate the top, the handle member having a first collar proximate the cap end and second collar proximate the inserting end; and wherein the first and second collar define a gripping area of the handle member therebetween.

6. The ski pole of claim 1 wherein the illuminating means comprises:

(a) a light source, the light source being disposed within the translucent medial portion approximate the first engaging end;

(b) a source of power in electrical communication with the light source, the source of power being removably disposed within the tubular upper member;

(c) a switch, the switch controlling the electrical communication between the source of power and the light source.

7. The illuminating means of claim 6 wherein the light source comprises:

an incandescent light removably disposed within the translucent medial portion.

* * * * *